United States Patent [19]

Wood et al.

[11] Patent Number: 4,619,215

[45] Date of Patent: Oct. 28, 1986

[54] DUAL STEP, VEE TYPE PLANING HULL FOR POWER BOATS

[75] Inventors: Forrest L. Wood, Flippin; Dale H. Jensen, Everton; Kenneth P. Poley, Yellville; Charles C. Hoover; Gary L. Wilson, both of Bull Shoals, all of Ark.

[73] Assignee: Wood Manufacturing Company, Inc., Flippin, Ark.

[21] Appl. No.: 719,528

[22] Filed: Apr. 3, 1985

[51] Int. Cl.[4] ..... B63B 1/18

[52] U.S. Cl. ..... 114/56; 114/291; 114/271; 440/66

[58] Field of Search ..... 114/271, 290, 291, 56, 114/57, 288; 440/66; D12/313, 314

[56] References Cited

U.S. PATENT DOCUMENTS 4,361,102 11/1982 Wood et al. ..... 114/56
4,398,483 8/1983 Wood et al. ..... 114/56

FOREIGN PATENT DOCUMENTS 922199 3/1963 United Kingdom ..... 114/56

*Primary Examiner*—Trygve M. Blix
*Assistant Examiner*—Edwin L. Swinehart
*Attorney, Agent, or Firm*—Wayne B. Stone, Jr.

[57] ABSTRACT

A deep vee entry hull is disclosed and includes a central running surface flanked in the after portion thereof, by inboard, intermediate and outboard running surfaces. The central and inboard surfaces terminate at the aft ends thereof in a first transverse step while the intermediate running surfaces terminate in a second transverse step aft of the first.

7 Claims, 5 Drawing Figures

DUAL STEP, VEE TYPE PLANING HULL FOR POWER BOATS

BACKGROUND OF THE INVENTION

The invention relates to open power boats of the type used in fishing tournaments and other recreational boating and particularly to the hull configuration thereof.

In those vee entry boats having top speeds in excess of 70 MPH, with which the invention is particularly concerned, the choice of hull configuration necessarily involves tradeoff considerations of fuel economy on the one hand and high speed performance on the other.

At low speeds, deep vee entry hulls tend to exhibit a "bow up" attitude since the center of gravity is necessarily well aft of amidship to permit high speed planing. This "bow up" attitude, at low speed, is counteracted by the thrust of a transom mounted propulsion unit. The drive propeller must operate in "hard" water issuing from beneath the hull and across the plane of the transom. Thus, in the past, if a propulsion unit be mounted directly to the transom, it was necessary to impart sufficient negative trim to the unit to avoid cavitation due to the proximity of the drive propeller to the transom which, in turn, produces vertical thrust vectors thus reducing maximum overall performance than can be obtained with pure horizontal thrust. The alternative, a greater depth position of the drive unit, produces an unacceptable drag increase.

Fuel efficiency and decreasing time requirement for coming on plane from a low speed condition vary inversely with increasing negative trim to maintain "hard water" position of the drive propeller. One method of combating the foregoing is through the use of an angled transom and a transom step as referred to in applicants' prior U.S. Pat. No. 4,233,920. Even with the use of these hull modifications it is still necessary that the center line of the drive propeller be at the approximate depth of the hull center line to achieve hard water submergence without negative trim. Since drag increases exponentially with increasing propulsion unit submergence, a decrease of even an inch or two of submergence results in significant improvements in performance and fuel economy. The advantages in the avoidance of vertical thrust vectors from a negatively trimmed propulsion unit are obvious.

The usual method of achieving adequate hard water submergence for the drive propeller at a higher level in a pure horizontal thrust mode is to mount the propulsion unit in aft spaced relation to the transom by a special mounting plate commonly known as a "jack plate". The extra weight and expense of such a "jury rig" mounting is eliminated by the dual step hull herein disclosed. The primary purpose of the invention is to provide a hull configuration which allows a more shallow propulsion unit mounting (the center line of the drive propeller above the bottom of the hull center line) while yet assuring hard water submergence of the drive propeller in a pure horizontal thrust mode.

Another purpose of the invention is an improvement in the aft wedge configurations associated with the intermediate and outboard running surfaces to improve high speed turning characteristics and porpoising control. Typical prior art is found in applicants' prior U.S. Pat. Nos. 4,361,102 and 4,398,483.

SUMMARY OF THE INVENTION

A deep vee entry hull includes a central running surface respectively flanked, in the after protion thereof, by inboard, intermediate and outboard running surfaces. The central and inboard running surfaces terminate at the aft ends thereof in a forward transverse notch, or step, which is well forward of the transom while the intermediate running surfaces terminate in an aft transverse notch, or step, spaced above the forward step and between the forward step and the transom.

With an outboard propulsion unit mounted to the transom, the presence of the after transverse step allows the position of the forward transverse step to be further forward than was previously possible so that water leaving the area of the central and inboard running surfaces, enroute to the propeller, produces a higher hard water zone at the plane of the transom mounted propulsion unit. This, in turn, permits a higher propulsion unit mounting.

The deep vee entry hull tapers aft to a more flattened V-shape amidship and transitions rearwardly thereof to terminate in a modified gull wing appearance, viewed in cross-section, as a consequence of the outer running surfaces being concavely configured in the after portion thereof. The result is that, in the after portion of the hull, the lateral outermost portion of the hull extends well below a straight line extrapolation of the mid portion of the aft hull configuration defined by the inboard and intermediate running surfaces.

The outermost portions of the outer concave running surfaces at the aft end of the hull, therefore, have a lesser clearance above the water line on plane and make wetted contact early on in a turning maneuver after moving through a lesser lay over arc than is the case with a conventional vee hull. This initial wetting contact is one of gradually increasing resistance as the turn is tightened rather than an immediate impact along a broad planar surface so that the tendency to "chine walk" or skid is reduced as a function of the shape of the concavity. In addition to reducing impact "bounce" the concave running surface on the inside of the turn funnels outflowing water smoothly away from the central portion of the hull and imparts a downward component to the lateral outflow which produces an upward turn stabilizing force on the stern at the inside of the turn. As the turn is further tightened to maximum the increasing submergence of the concave running surface produces a more than linear resistance to stern skid as a function of the greater reach and shape of the concave running surface "digging in" as compared with a conventional, planar running surface. Since these turning maneuvers involve, in effect, a yawing movement of the boat initiated from the stern, it is desirable that the bow of the boat present minimal resistance to such movement which explains the transitioning of the outer running surface from more planar, forward to concave, aft with the transition being effected approximately amidship.

A primary purpose of after wedges is to reduce porpoising and where the transom is notched or "stepped" as in the present case, the presence of after wedges at the aft end of those running surfaces immediately straddling the forward-most stepped portion of the transom are particularly important in the control of high speed porpoising since that is the only portion of the extreme aft end of the boat that is in "hard water". Stated differently, where the after end of the keel line and its associated running surfaces terminate short of the stern (in a transverse "step"—the aforesaid forward step) the only remaining hull area in hard water, on plane, where a bow down torque can be maximally exerted is at the aft end of the running surfaces immediately straddling the forward-most "step".

A necessary tradeoff for this porpoising control is some increase in drag because of the laminer exit flow disruption from the inboard running surfaces as a function of the downward (stern lifting) flow component imparted by the wedges. This drag factor is substantially reduced by the novel inboard, forward step-straddling wedges herein disclosed which are tapered inboard and aft from the chine lines defining the outboard limits of the intermediate running surfaces. The purpose is to shift the lateral component of outflowing water awav from the outboard chine lines to exit the running surfaces inboard thereof where there is no outflow disruption bv a chine line (the inboard chine lines being terminated at the forward-most "step").

This inboard wedge construction substantially reduces exit laminer flow disruption as opposed to the prior art (U.S. Pat. No. 4,398,483) where the additional lift achieved by direcing exit flow across a chine line is needed for boats with slower "on plane" speeds.

The inboard wedges just described, as would be expected, produce less upward, stern lifting force than conventional wedges which produce a greater exit laminer flow disruption however they are adequate for their primary, intended function; to maintain a bow down attitude at running speeds in the 60–70 MPH range. At lower speeds, when the outer running surfaces are in hard water, additional outboard running wedges come into play.

At the aft ends of the concave, outboard running surfaces are transverse wedges which, as viewed in plan, have the shape of a minor segment of a circle. The outboard wedges are centrally located at the aft ends of the outboard running surfaces but do not extend across the full width thereof. Because of the proportionately greater turning effect that is achieved at the outer concave running surface, the bow down attitude that can normally be obtained from inboard wedges is insufficient to prevent porpoising while a wedge extending fully across the concave running surface produces excessive resistance, i.e. it has been found that in a tight turn with a concave running surface well submerged, the outer running surface must still be able to slip water aft in a laminer fashion over at least a portion of its width to avoid unacceptably high drag loses on turn.

The purpose and positionment of the circle segment wedges on the outer running surfaces is to permit exit, laminar flow to either side thereof as opposed to prior art wedges where exit laminar flow was only to the inboard or outboard side of the outer running surface wedges. The advantage is a lesser lateral flow component to disrupt the laminar outflow area adjacent the wedges. The semi-circular shape, as opposed to prior art wedge shapes, is to allow more ready transverse "slip" of that water to which a downward flow component has been imparted transversely to either side of the wedges.

DESCRIPTION OF THE PREFERRED EMBODIMENT

Figure 1:
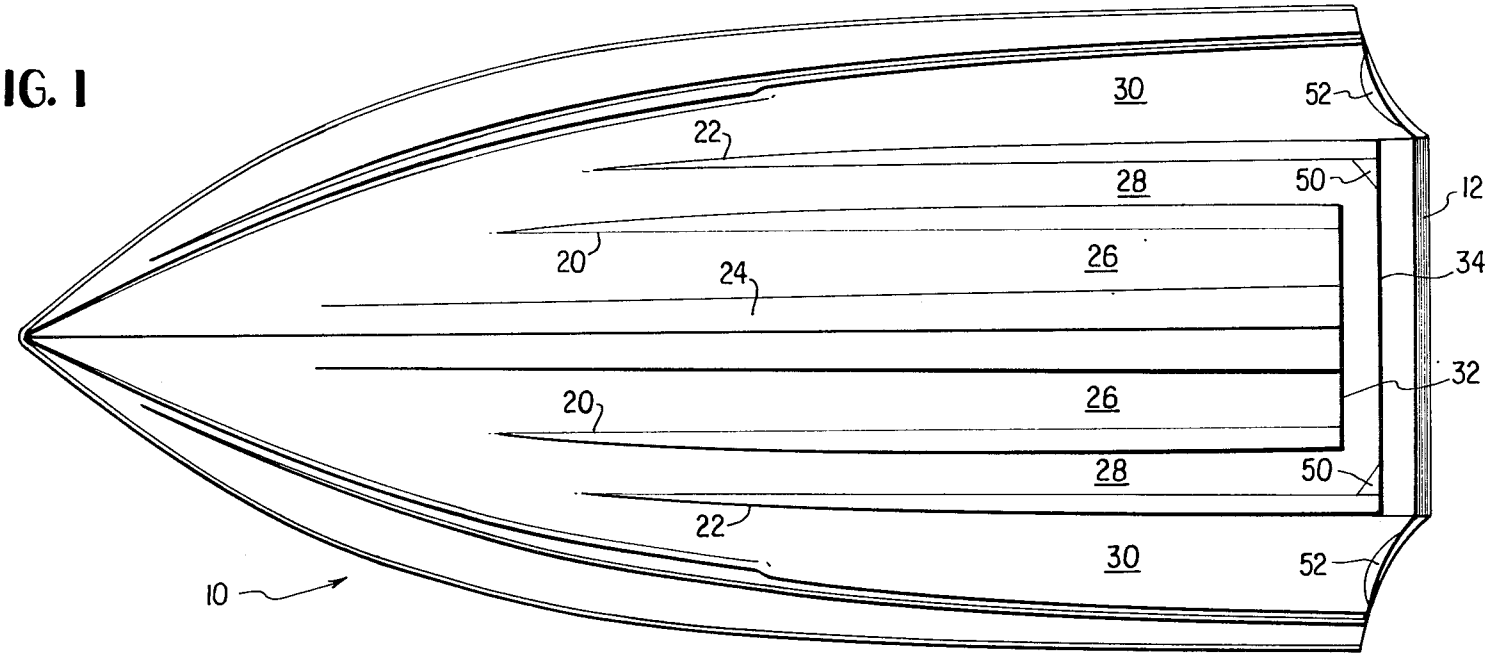
FIG. 1 is a bottom plan view of the boat of the present invention.
Figure 2:
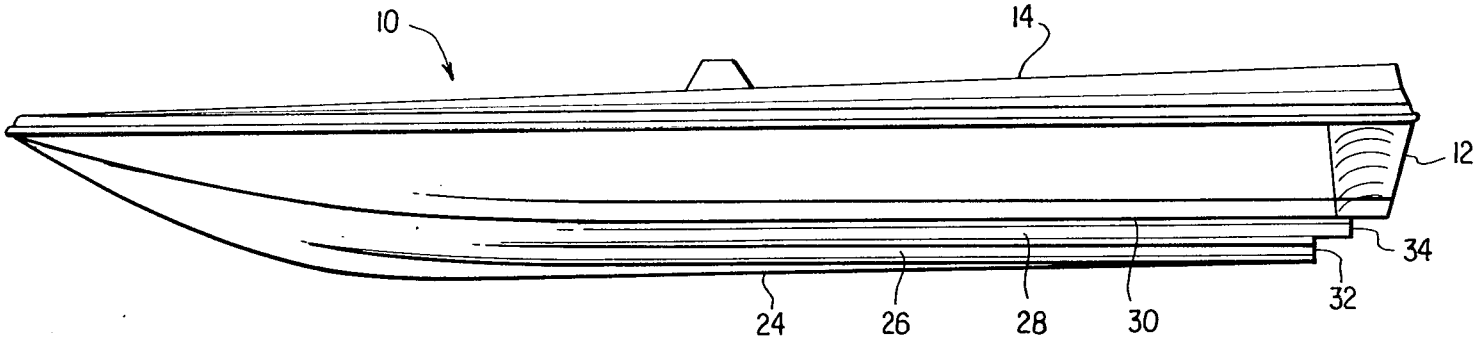
FIG. 2 is a side elevation of the boat.
Figure 3:
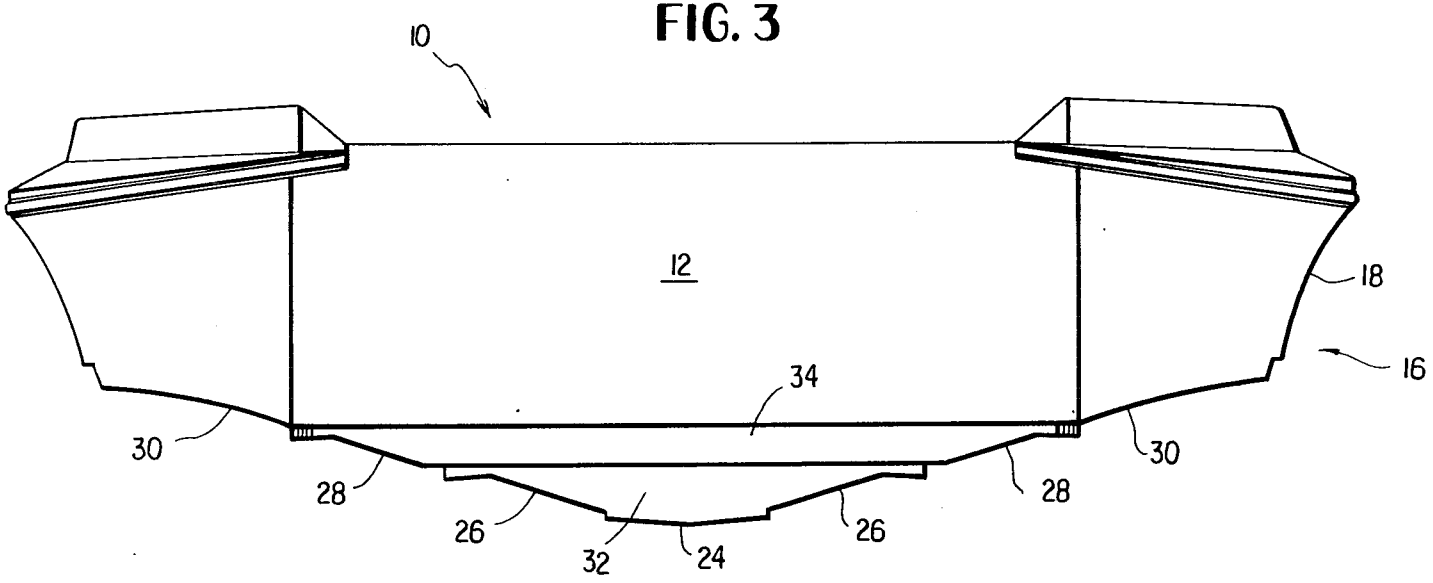
FIG. 3 is a rear elevation.

In FIGS. 1–3 is illustrated an open power boat 10, adapted to be driven by an outboard propulsion unit (not shown) mounted to transom 12, including a deck portion 14 surmounting the novel deep vee entry hull 16 which is the subject of the present invention.

The undersurface of hull 16 includes inboard and outboard chine pairs 20, 22 extending forward from the stern to terminate short of the bow.

The after center line keel portion, or central running surface, 24 is flanked by planar, inboard and intermediate running surfaces 26, 28 and concave, outboard running surfaces 30. Central and intermediate running surfaces 24, 26 terminate, aft, in a transverse notch, or step, 32 which is well forward of transom 12. Intermediate running surfaces 28 terminate in a notch, or step, 34 which is above step 32 and intermediate step 32 and transom 12. The net, effective result of this double step configuration is to raise the level of the "hard water" flow path issuing from the central and inboard running surfaces enroute to a transom mounted drive propeller. The drive propeller may thus be submerged to a lesser depth which greatly reduces propulsion unit drag.

Figure 4B:
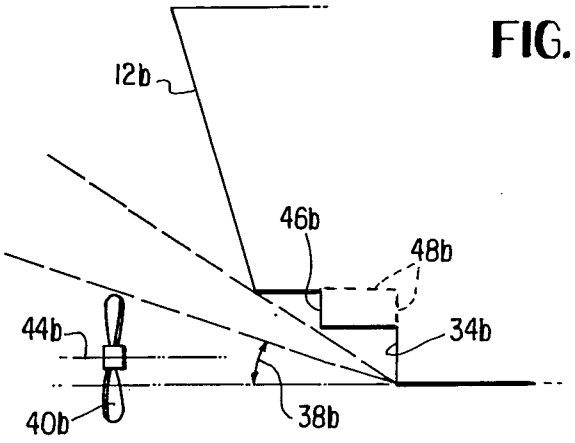
FIGS. 4*a* and 4*b* are schematic depictions of the drive propeller depth positionment in accordance with prior art teachings and the present invention, respectively.
Figure 4A:
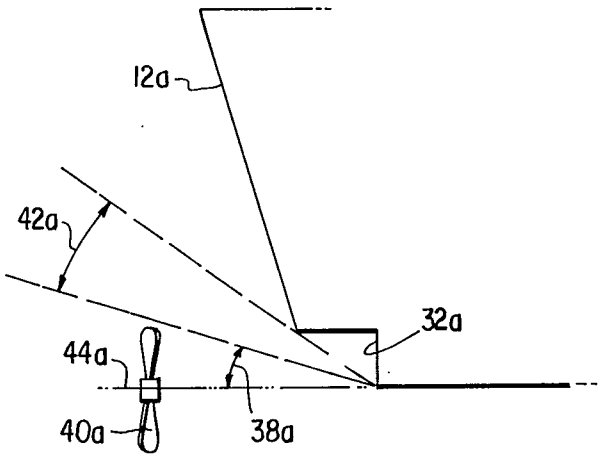
FIG. 4a PRIOR ART

FIG. 4*a* is exemplary of the prior art showing the combination of an angled transom 12*a* and a transom notch, or step, 32*a* which permits direct transom mounting of the propulsion unit with the drive propeller in a pure horizontal thrust mode, on plane, and operating within the "hard water" zone 38*a*. In the class of boats with which the invention is concerned, the required propulsion unit mounting depth to insure that drive propeller 40*a* operates below the turbulent zone 42*a* in pure horizontal thrust, on plane, places the propeller drive shaft 44*a* approximately in line with the keel center line bottom.

The addition of another, forward, step 34*b* allows the water issuing from the central and inboard running surfaces to exit further forward and thus define, at the plane of the propeller 40*b*, a higher "hard water" zone 38*b*. In actual practice it has been found that the propeller drive shaft 44*b* may be positioned 2 inches higher than was previously possible. This construction allows the water issuing from the exit ends of the central and inboard running surfaces to take an upward trajectory well forward of that which has been previously known. More specifically, the exit issuance is $11\frac{1}{4}$ inches forward of the lower, forwardmost portion of transom 12*b* as opposed to the prior art exit issuance at approximately $5\frac{3}{4}$ inches forward of transom 12*a*.

It is not possible to get the same effect by combining transverse steps 46*b* and 34*b* such as by making a larger, single, step as schematically indicated by phantom lines 48*b*. A notch or step of appreciably greater dimension than $5\frac{3}{4}$ inches in length by $4\frac{1}{4}$ inches in depth exhibits an exponential increase in drag, due to cavitation in the notch, as the notch size is further increased.

Wedges 50 are tapered inboard and aft and lie at the aft ends of intermediate running surfaces 28.

Circle segment wedges 52 lie at the aft end of outboard running surfaces 30, are centrally positioned with respect thereto and terminate on both the inboard and outboard ends short of the full transverse width of running surfaces 30.

In addition to the function of the circle segment wedges in high speed turns, already described, they cooperate in low speed running, with wedges 50 to produce a bow down attitude while their termination short of the full transverse width of running surfaces 30 provides a laminar flow exit path from both the inboard and outboard portions of the running surfaces.

We claim:

1. A deep vee entry hull having an angled transom and a central running surface extending fore and aft of the hull flanked, in the after portion thereof, by inboard, intermediate and outboard running surfaces; said intermediate running surfaces terminating at the after ends thereof in a first transverse step forward of said transoms and extending transversely between said intermediate running surfaces; and said central and inboard running surfaces terminating at the after ends thereof in a second transverse step, parallel with and forward of said first transverse step.

2. The hull of claim 1 including wedges at the after ends of said intermediate running surfaces; and said wedges being tapered inboard and aft.

3. The hull of claim 1 including semi-circular wedges at the after ends of said outer running surfaces; and said wedges being centrally positioned and of lesser lateral extent than said outer running surfaces.

4. The hull of claim 3 wherein said outboard running surfaces are concave in the after portions thereof.

5. A deep vee entry hull as set forth in claim 1 wherein:

the aft most extent of said first step terminates forward of a plane extending upwardly and aft from the lowermost extent of said second step to the lowermost extent of said transom.

6. A deep vee entry hull as set forth in claim 1 wherein:

said second transverse step is substantially eleven inches forward of the bottom of said transom.

7. A deep vee hull as set forth in claim 5 wherein:

said second transverse step is substantially eleven inches forward of the bottom of said transom.

* * * * *